US005827378A

United States Patent [19]

Belenkiy

[11] Patent Number: 5,827,378

[45] Date of Patent: Oct. 27, 1998

[54] METHOD OF TREATMENT OF METALLIC WORKPIECES

[75] Inventor: Gennadiy Belenkiy, New York, N.Y.

[73] Assignee: ACDS Technologies, Ltd., Sparks, Nev.

[21] Appl. No.: 668,941

[22] Filed: Jun. 24, 1996

[51] Int. Cl.[6] ..... C21D 1/09

[52] U.S. Cl. ..... 148/561; 148/565

[58] Field of Search ..... 148/525, 561, 148/565, 403

[56] References Cited

U.S. PATENT DOCUMENTS

| | | | |
|---|---|---|---|
| 4,398,966 | 8/1983 | Kelly et al. | 148/565 |
| 4,755,237 | 7/1988 | Lemelson | 148/403 |

*Primary Examiner*—George Wyszomierski
*Attorney, Agent, or Firm*—Herbert Dubno

[57] ABSTRACT

Metal workpieces are subjected to laser treatment in a liquefied gas, by passing the laser beam through a layer of liquid nitrogen in direct contact with the metal surface to be treated, thereby creating an amorphous state.

13 Claims, 3 Drawing Sheets

METHOD OF TREATMENT OF METALLIC WORKPIECES

FIELD OF THE INVENTION

My present invention relates to a method of and to an apparatus for the treatment of metallic workpieces and, more particularly, to a method of and an apparatus for transforming at least a surface region of a metallic workpiece into an amorphous structure.

BACKGROUND OF THE INVENTION

The use of a pulsed laser for the treatment of the surface of a metallic workpiece is described in a number of prior patents including U.S. Pat. Nos. 4,539,461, 4,755,237, 4,398,966, 4,684,781 and 5,209,791. These patents describe treatments utilizing the laser beam to effect a transformation, generally to a molten state and the quenching thereof. For example, U.S. Pat. No. 4,398,966 rapidly heats chromium nickel steel alloys to a solid solution temperature and then cools that structure at a rapid cooling rate.

A pulsed laser operating at a power of, say 250 to 350 watts, at a wavelength of 0.5 to 11 $\mu$m with a pulse rate of about 100 to 200 pulses per second can be used. The depth of melting is say 0.5 mm with greater or lesser depth being selected as desired and a spot diameter being about 0.25 to 1.3 mm. The laser beam can be swept across the surface with a travel speed of up to 1.5 to 2 meters per minute. In this case, the body itself forms a heat sink for rapidly cooling down the surface when the beam leaves the heated spot.

In U.S. Pat. No. 4,539,461, the laser beam is used for hardening flank and root areas of gear teeth utilizing a nonlinear scanning technique. Back-tempering is prevented by directing cooling liquid onto gear tooth flanks opposite those currently being hardened. The cooling fluid can be liquid nitrogen. This latter patent recognizes that the high rate cooling of the laser-treated surface is advantageous and can utilize a liquefied gas to augment any natural cooling which may result by conduction of heat away from the laser-treated site.

Thus, while it has been recognized in the art that advantages can be gained by the rapid cooling of a surface region of a metal workpiece which is treated with a laser and especially a pulsed laser beam, the problem of providing a satisfactory degree of cooling and a satisfactory cooling rate to achieve an optimal transformation of a surface region of the metal workpiece into an amorphous state has remained. Indeed, none of the patents mentioned describes a method which can yield the cooling speed at the metal surface which is sufficient to obtain a continuous amorphous structure of the treated region.

Furthermore, regions heated by a pulsed laser beam tend to be rapidly oxidized and, since there is an overlap of between 30 and 50% of each treated spot by the next treated spot when the laser beam and the surface are relatively displaced, there are areas which are oxidized twice in each treatment.

While the laser beam treatments described above thus represent a significant advance in metallurgical operations, in practice the workpiece, which may be a tool, tends to suffer irregular wear in the treated regions.

When a liquefied gas is used to supplement the cooling in the manner described, the liquefied gas expenditure is considerable and frequently the treated surface is covered by a layer of "snow" resulting from condensed and solidified moisture which can obscure the treated surface and even prevent access of the laser beam to it.

The apparatuses which have been used for the earlier treatments also tend to be rather complex at least in part because of the need to train a laser spot on a very specific region while providing contact of liquefied gas with another region and eliminating the presence of the "snow", etc.

OBJECTS OF THE INVENTION

It is the principal object of the present invention to provide an improved method of treating a metallic workpiece with a laser beam, especially a pulsed laser, whereby drawbacks of earlier techniques are avoided.

It is a further object of this invention to provide an improved apparatus which is of simpler construction and easier to operate than systems which have hitherto been used for the treatment of metal surfaces with laser beams.

Still another object of the invention is to provide an improved method of and apparatus for the treatment of a metal structure with a sufficient cooling rate following pulsed laser heating of a surface region that a transformation into an amorphous state is readily obtained without the danger of oxidation or obstruction of the treated surface by "snow" or the like.

SUMMARY OF THE INVENTION

These objects and others which will become apparent hereinafter are attained, in accordance with the invention in a method of treating a metal workpiece with a pulsed laser which comprises contacting the workpiece with a liquefied gas to preliminarily cool the workpiece and then training a laser beam of a pulsed laser against a surface of the workpiece body through a layer of liquefied gas. In its method aspects the method can thus comprise the steps of:

(a) immersing a metal workpiece in a bath of a liquefied gas so that a surface of the metal workpiece lies below a layer of the liquefied gas;

(b) cooling a metal workpiece in a bath of a liquefied gas to the temperature of the liquefied gas;

(c) directing a pulsed laser beam through the layer onto a spot on the surface to locally heat the surface at the spot while the surface is covered with the layer, thereby generating an amorphous structure at the spot; and (d) relatively displacing the laser beam and the workpiece to shift the spot on the surface.

The heart of the invention is the fact that the surface of the workpiece which is to be treated is covered by the liquefied gas in this liquid form, thereby excluding from this surface any "snow", any oxidizing agent, and any potential contaminant.

I have found, quite surprisingly, that in spite of the fact that the surface of the workpiece to be treated is covered with a layer of the liquefied gas, the laser beam can be trained upon that surface to heat that surface to the requisite temperature for transformation of that surface region into an amorphous state, and that the immediate cooling provided by the body of the liquified gas in which the workpiece is immersed and in direct contact with the heated zone, affords the rapid cooling necessary to freeze any amorphous state which is produced.

According to a feature of the invention the liquefied gas is at a temperature below −70° C. and is liquid nitrogen or another liquefied gas as may be necessary according to the technology. Suitable liquefied gasses and the temperatures at which they are used are $N_2$<−170° C., CO<−191.5° C., $O_2$<−183° C., methane<−161.6° C., $CO_2$<−78.5° C., He<−269° C., $H_2$<−253° K.) and argon<−180° C. The liquefied gas can be confined in a vessel having a window transparent to the laser beam in direct contact with the liquefied gas which fully fills the space between this window and the surface of the workpiece which is treated, the laser beam being directed against this surface through the window. The liquefied gas is thus in contact with one wall of the window and the laser beam is directed through a window from the opposite side.

To prevent condensate on the window wall and the formation of "snow" thereon, a space bounded by this opposite glass walls of the window is evacuated.

The apparatus according to the invention can comprise:

a thermally insulating vessel containing a bath of a liquefied gas in which a metallic workpiece is immersed so that a surface of the metal workpiece lies behind a layer of the liquefied gas;

means forming a window transparent to a pulsed laser beam in contact with the liquefied gas;

a pulsed laser generating the beam and directing the pulsed laser beam through window and through the layer onto a spot on the surface to locally heat the surface at the spot while the surface is covered with the layer, thereby generating an amorphous structure at the spot; and means for relatively displacing the laser beam and the workpiece to shift the spot on the surface.

The method and apparatus of the invention may be used for substantially any purpose for which laser beam treatment has been found to be desirable. For example, it may be employed for generating an amorphous structure in the cutting and wear surfaces of a tool, can increase the wear and corrosion resistance of tools and other bodies having bearing surfaces, it can be used for welding and cutting structures and connecting leads to electrical circuit elements without heating of other structures in the region thereof. It also may be used for producing small holes and slots with high accuracy and low surface roughness.

It has been found to be advantageous, moreover, to utilize the technique for removing films which have been coated onto workpieces in selected areas without heating of the entire body, or for alloying films onto surfaces of metal workpieces. It can be used to repair cracks and pores and other surface defects without overheating and thus has applications in the restoring of jewelry by processes involving welding and cutting without heating precious stones. I have also found that treatment with a laser beam under the conditions described can improve the heat resistance of X-ray tube, anodes, magnetron and klystron collectors. It can be employed to alter structures of metal workpieces in very small regions.

In practice, the processes of the invention results in superficial vitrification of the surface region of the workpiece because of the coaction of the laser beam heating and the immediate cooling resulting from the presence of the liquefied gas in the immediate region of the heating. The product has high wear and corrosion resistance in the treated region and deformation and distortion are excluded, since the remainder of the body is not heated.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
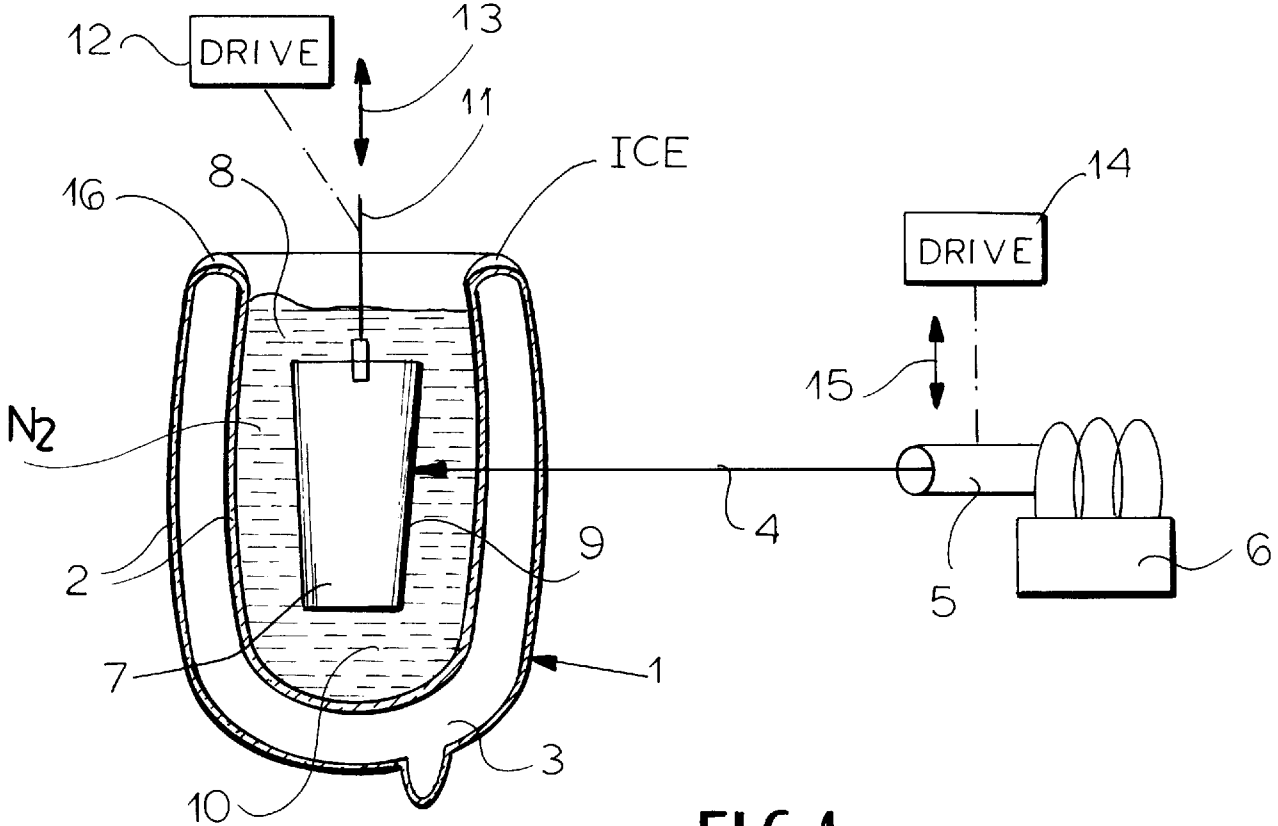
FIG. 1 is a cross sectional view illustrating one apparatus which can be used for carrying out the method of the invention.

Basically an apparatus for carrying out the process of the present invention can comprise a Dewar vessel 1 which is composed of inner and outer glass walls 2 defining an evacuated space 3 between them. The walls 2 are transparent to a laser beam 4 from a pulsed laser 5, the pumping system of which is represented at 6. A workpiece 7 is suspended in a body of liquefied gas 8 within this vessel so that a surface 9 of the workpiece is in direct contact with liquefied gas which fills the space between this surface 9 and the wall 2 through which the laser beam is directed.

The means for suspending the workpiece 9 in the bath is represented at 11. While ice can form at 16 on the top of the Dewar vessel, it does not obscure the walls 2 which are transparent to the laser beam. The laser beam is trained on the metal workpiece 7 and locally heats the latter through the liquefied gas which instantaneously cools the heated surface. The suspender 11 may be provided with a drive 12 for displacing the suspender and the workpiece in the direction of arrow 13 or the laser may be connected with a drive 14 for displacing the laser in the direction of arrow 15 to sweep the pulsed laser beam over the metal object.

Figure 2:
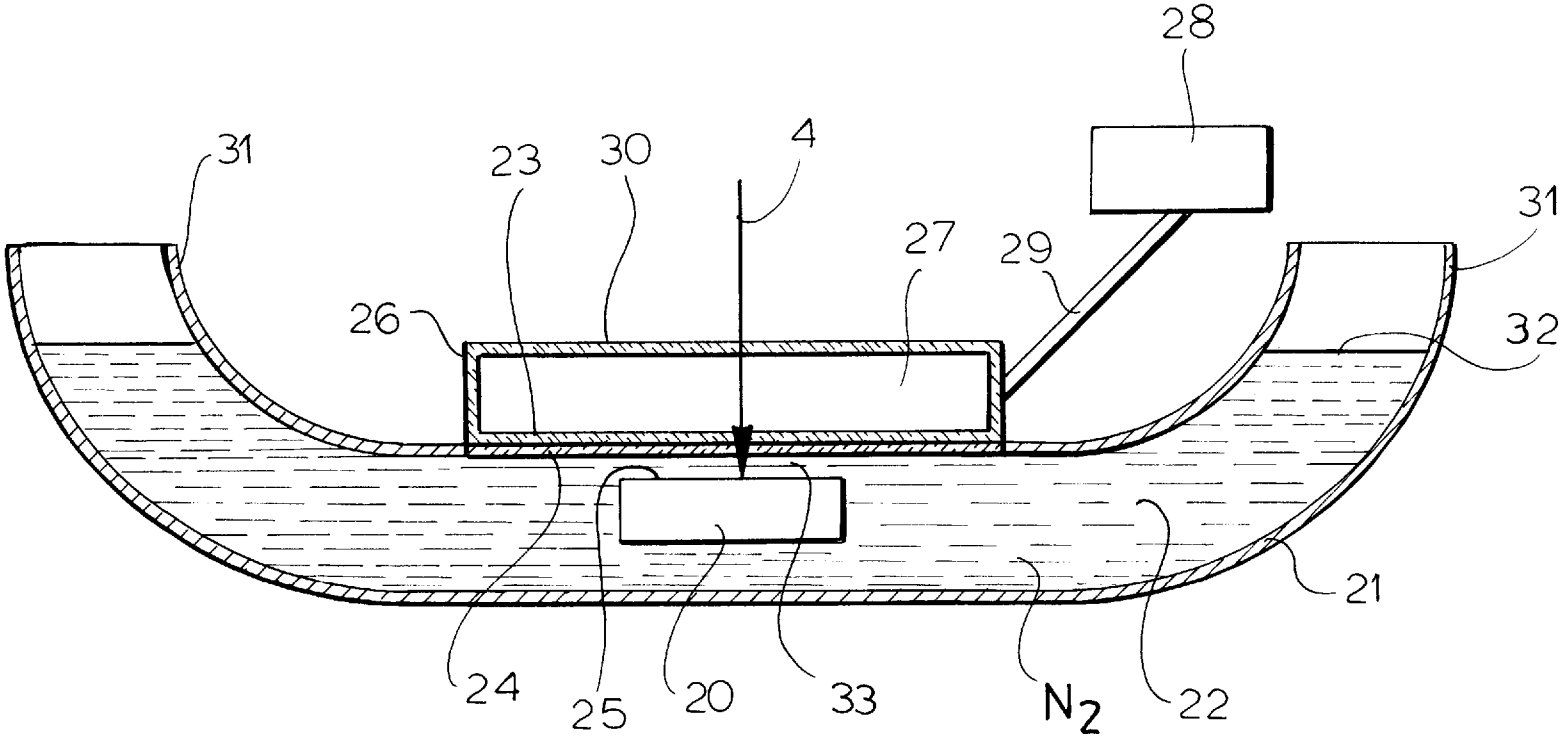
FIG. 2 is a diagrammatic cross section through a second apparatus for practicing the invention.

Another system for treating a workpiece 20 with a laser beam 4 has been shown in FIG. 2, where a metal vessel 21 receives the liquefied gas 22 and has a double wall glass window 23 and 30 through which the laser beam can be trained on the workpiece 20. The surface 24 of the window 23 facing the workpiece 20 is in direct contact with the liquefied gas as is the surface 25 to be treated with the laser beam. To prevent the formation of snow on the window walls 23 and 30, the side of the latter turned to the atmosphere is enclosed by a housing 26 to form a space 27 which is evacuated by a suction pump 28 connected to the space 27 by a pipe 29. An outer wall 30 of the space 27 is also composed of glass and is transparent to the pulsed laser beam 4. Upwardly turned portions 31 of the vessel 21 allow the level 32 of liquefied gas to lie above the workpiece 20, thereby ensuring that the layer 33 of liquefied gas will be maintained between the surface 25 and the inner surface 24 of the glass window 23.

The apparatus of FIG. 2 is operated like the apparatus of FIG. 1, i.e. the workpiece is positioned in the bath of liquid nitrogen, below the surface of this bath or such that the laser beam is directed through a layer of the liquefied gas against the surface of the metal workpiece to be treated. Laser beam heating of the surface is effected with instantaneous cooling in the manner described.

Figure 3:
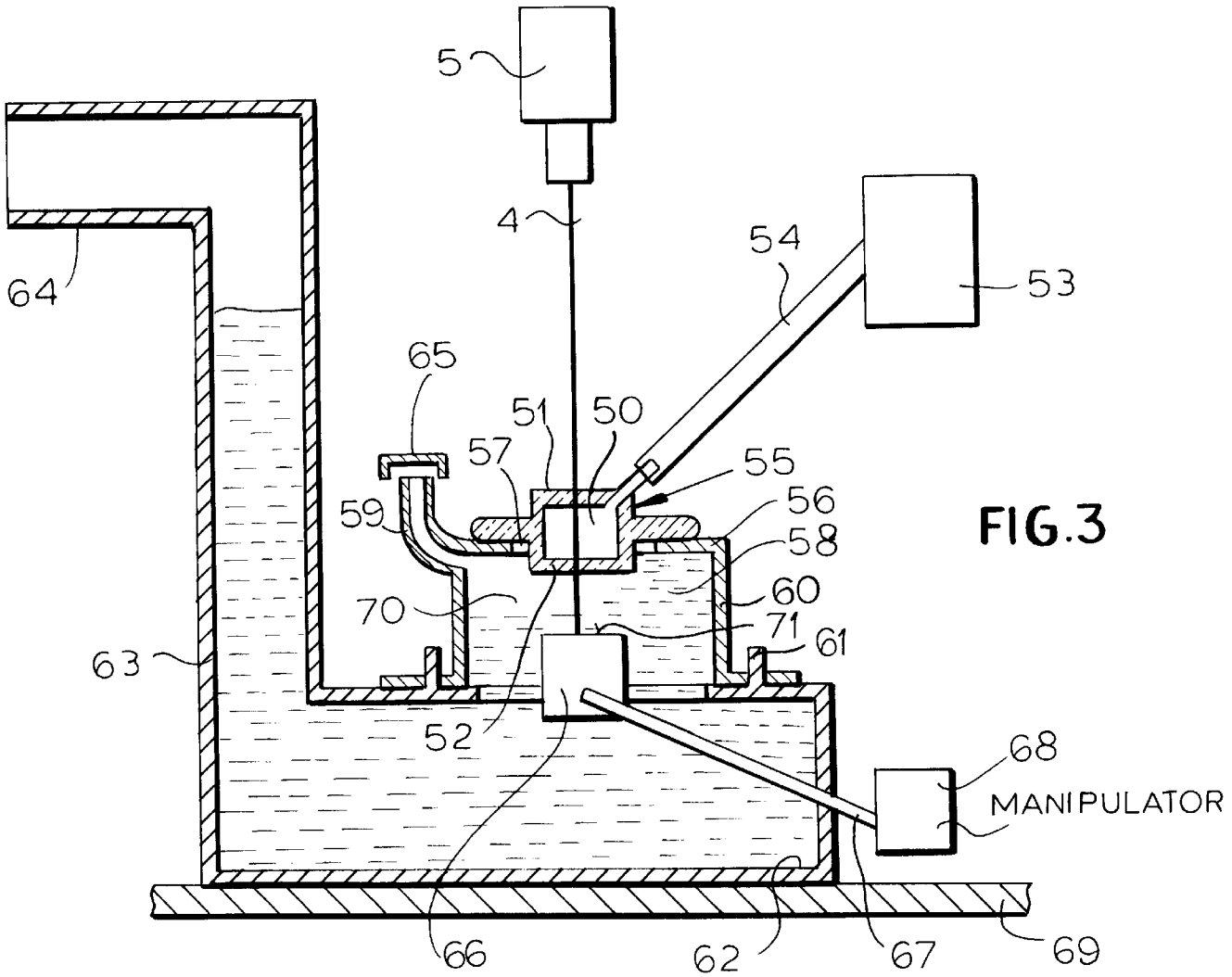
FIG. 3 is a vertical section through another apparatus for carrying out the method of this invention.

In the embodiment of FIG. 3, the pulsed laser beam 4 is directed by the laser 5 through window walls 51 and 52 of a chamber 50 which is evacuated by the suction pump 53 via the pipe 54. The glass unit formed with the window walls 51 and 52 has been represented at 55 and is positioned on a cover 56 formed with an opening 57 through which the window wall 52 can project into the bath of liquefied gas shown at 58.

A spout 59 is formed on a housing 60 which is positioned on pins 61 of a liquefied gas vessel 62 with a neck 63 and a spout 64. The spout 59, which can be closed by a cap 65, allows liquefied gas to be supplied to the vessel 62 to fill the housing 60.

The workpiece 66 is positioned in the liquid nitrogen bath via a manipulator arm 67 of a manipulator 68 and the entire assembly can be positioned on a coordinate table 69 allowing the workpiece 66 to be shifted in two mutually perpendicular horizontal directions relative to the laser beam 4. Here, as in the other embodiments, the layer 70 of liquefied gas is provided between the surface 71 of the workpiece 66 and the window's wall 52. The laser beam 4 is thus directed at the workpiece 66 through this layer of liquefied gas. By way of example, in all of the embodiments a steel tool is the workpiece and can be treated along its cutting edge using a solid-state laser with a power of 35 to 40 Joules, a pulse duration of 4 to 7 microseconds and a wavelength as indicated previously in liquid nitrogen to transform the surface region to a depth of the order of 0.5 mm to an amorphous state, thereby greatly increasing wear and corrosion resistance without the danger of oxidation.

The apparatus of FIG. 3 allows control of the layer 49 of the liquefied gas above the surface 43 of the workpiece.

I claim:

1. A method of treating a surface of a metal workpiece to generate an amorphous structure therein, said method comprising the steps of:

(a) confining a liquefied gas in a bath in a vessel having a window transparent to a laser beam, said window being in direct contact with said liquefied gas;

(b) immersing a metal workpiece in said bath of a liquefied gas so that a surface of said metal workpiece lies below a layer of said liquefied gas;

(c) cooling the metal workpiece in said bath to a temperature of said liquefied gas;

(d) directing a pulsed laser beam to which said window is transparent through said layer onto a spot on said surface through said window to locally heat said surface at said spot while said surface is covered with said layer, thereby generating an amorphous structure at said spot; and (e) relatively displacing said laser beam and said workpiece to shift said spot on said surface.

2. The method defined in claim 1 wherein said liquefied gas is in contact with one side of said window, said laser beam is directed through said window from an opposite side, and said method further comprises the step of evacuating a space bounded by said opposite side of said window.

3. The method defined in claim 2 wherein said liquefied gas is selected from the group consisting of liquid nitrogen, carbon monoxide, oxygen, methane, carbon dioxide, helium, hydrogen and argon.

4. The method defined in claim 1 wherein said workpiece is a tool and said surface is a wear bearing edge.

5. The method defined in claim 1 wherein said workpiece is a body having a wear bearing surface which is treated by said laser beam to increase wear resistance and corrosion resistance.

6. The method defined in claim 1 wherein said workpiece is a thin-wall body welded by said laser beam.

7. The method defined in claim 1 wherein said workpiece is a thin-wall body which is cut through by said laser beam.

8. The method defined in claim 1 wherein said workpiece is a thin-wall body which is pierced by said laser beam.

9. The method defined in claim 1 wherein said workpiece is a body provided with a surface film which is alloyed to the body by said laser beam.

10. The method defined in claim 1 wherein said workpiece is a body provided with a surface film which is partly removed by said laser beam.

11. The method defined in claim 1 wherein said workpiece is a body having surface defects which are healed by said laser beam.

12. A method of treating a surface of a metal workpiece to generate an amorphous structure therein, said method comprising the steps of:

(a) immersing a metal workpiece in a bath of a liquefied gas so that a surface of said metal workpiece lies below a layer of said liquefied gas;

(b) cooling the metal workpiece in said bath to a temperature of said liquefied gas;

(c) directing a pulsed laser beam through said layer onto a spot on said surface to locally heat said surface at said spot while said surface is covered with said layer, thereby generating an amorphous structure at said spot; and (d) relatively displacing said laser beam and said workpiece to shift said spot on said surface, said workpiece being a thin-wall body which is cut through by said laser beam.

13. A method of treating a surface of a metal workpiece to generate an amorphous structure therein, said method comprising the steps of:

(a) confining a liquefied gas in a bath in a vessel having a window transparent to a laser beam, said window being in direct contact with said liquefied gas;

(b) immersing a metal workpiece in said bath of a liquefied gas so that a surface of said metal workpiece lies below a layer of said liquefied gas;

(c) cooling the metal workpiece in said bath to a temperature of said liquefied gas;

(d) directing a laser beam to which said window is transparent through said layer onto a spot on said surface through said window to locally heat said surface at said spot while said surface is covered with said layer, thereby generating an amorphous structure at said spot; and (e) relatively displacing said laser beam and said workpiece to shift said spot on said surface.

* * * * *